US009278380B2

(12) United States Patent
Kunnas et al.

(10) Patent No.: US 9,278,380 B2
(45) **Date of Patent: *Mar. 8, 2016**

(54) CARPET WASHING EQUIPMENT AND METHOD FOR WASHING A CARPET WITH THE CARPET WASHING EQUIPMENT

(75) Inventors: Risto Kunnas, Masala (FI); Arvo Lahtinen, Vantaa (FI); Kari Matula, Anjalankoski (FI)

(73) Assignee: West Heat Rauma Oy, Masala (FI)

( * ) Notice: Subject to any disclaimer, the term of this patent is extended or adjusted under 35 U.S.C. 154(b) by 996 days.

This patent is subject to a terminal disclaimer.

(21) Appl. No.: 12/990,295

(22) PCT Filed: Apr. 29, 2009

(86) PCT No.: PCT/FI2009/050338

§ 371 (c)(1),
(2), (4) Date: Jan. 5, 2011

(87) PCT Pub. No.: WO2009/133244

PCT Pub. Date: Nov. 5, 2009

(65) Prior Publication Data

US 2011/0108070 A1 May 12, 2011

(30) Foreign Application Priority Data

Apr. 29, 2008 (FI) ..... 20085383

(51) Int. Cl.
*B08B 1/02* (2006.01)
*B08B 3/04* (2006.01)
(Continued)

(52) U.S. Cl.
CPC . *B08B 1/02* (2013.01); *A47L 11/00* (2013.01); *B08B 3/041* (2013.01); *D06G 1/00* (2013.01); *F26B 5/14* (2013.01); *F26B 13/24* (2013.01); *F26B 13/28* (2013.01)

(58) Field of Classification Search
CPC ..... D06G 1/00; B08B 3/022; B08B 1/02
USPC ..... 134/64 R, 105
See application file for complete search history.

(56) References Cited

U.S. PATENT DOCUMENTS 1,723,514 A 8/1929 Hermann
5,165,139 A * 11/1992 Oxman ..... 15/321
(Continued)

FOREIGN PATENT DOCUMENTS

DE 29614571 U1 12/1997
EP 1094146 A1 4/2001
(Continued)

OTHER PUBLICATIONS

Machine translation of EP1094146; Bindl, M., 2001.*
(Continued)

*Primary Examiner* — Michael Kornakov
*Assistant Examiner* — Natasha Campbell
(74) *Attorney, Agent, or Firm* — Berggren Inc.

(57) ABSTRACT

Equipment for washing a carpet includes a conveyor for transferring the carpet between washing and drying units, a control unit, at least one washing unit and at least one drying unit located in the transport direction after the washing unit, and elements for receiving production goods to the equipment. The conveyor is able to transfer the carpet through the washing and drying units with the same speed. The washing unit includes a wet or dry cleaning unit, with at least one brush and elements for transferring the carpet. Each drying unit has a blowing device for blowing compressed air at a pressure of 2-15 bars onto the pile side of the carpet, the blowing pressure depending on the carpet type and/or transfer speed of the carpet at a drying station of the drying unit, it being possible to blow such an amount of compressed air through the drying apparatus so that the carpet exits the drying station tack free.

18 Claims, 4 Drawing Sheets

(51) Int. Cl.

| | |
|---|---|
| ***D06G 1/00*** | (2006.01) |
| ***A47L 11/00*** | (2006.01) |
| ***F26B 13/24*** | (2006.01) |
| ***F26B 5/14*** | (2006.01) |
| ***F26B 13/28*** | (2006.01) |

(56) References Cited

U.S. PATENT DOCUMENTS

| | | | | |
|---|---|---|---|---|
| 5,469,598 | A * | 11/1995 | Sales | 15/321 |
| 5,548,905 | A | 8/1996 | Kuma et al. | |
| 5,992,051 | A * | 11/1999 | Salehibakhsh | 34/638 |
| 6,675,437 | B1 * | 1/2004 | York | 15/321 |
| 6,842,996 | B2 * | 1/2005 | Szarka | 34/83 |

FOREIGN PATENT DOCUMENTS

| | | | | |
|---|---|---|---|---|
| JP | 5331759 | A | | 12/1993 |
| JP | 2006218389 | A | * | 8/2006 |
| KR | 20030016163 | A | | 2/2003 |

OTHER PUBLICATIONS

English abstract of DE29614571; Boco GMBH & Co., 1997.*

Machine translation of JP2006218389; Takaoku et al., Aug. 24, 2006.*

International Search Report, dated Aug. 6. 2009, from corresponding PCT application.

* cited by examiner

CARPET WASHING EQUIPMENT AND METHOD FOR WASHING A CARPET WITH THE CARPET WASHING EQUIPMENT

BACKGROUND OF THE INVENTION

The invention relates to carpet washing equipment according to the before disclosure.

The invention also relates to a method washing a carpet using the carpet washing equipment disclosed.

DESCRIPTION OF THE RELATED ART

Known mechanical carpet washing apparatuses generally comprise a wet or dry cleaning apparatus, water rinsing apparatus, and a separate drying apparatus. The separate drying apparatus is, for example, a tumble drier. In addition, from the state of the art there are also known carpet washing apparatuses, which also include a drying unit. In this case the washing step is however performed as dry cleaning, because drying the carpet with the known methods to reach sufficiently low moisture and sufficiently fast is impossible. Such carpet washing apparatuses known from the state of the art are without exception located in stationary carpet laundries, which cannot be moved from one place to another.

SUMMARY OF THE INVENTION

With the above stated state of the art as the starting point, the inventor's first objective was to achieve, first of all, equipment for washing carpets, which equipment can be used both in wet and dry cleaning for a continuous cleaning of carpets so that the washing, rinsing and drying of the carpet would be done with the same equipment. A, second objective of the invention was to achieve equipment, which can be effortlessly moved from one place to another.

The objectives can be achieved with the equipment for carpet washing disclosed below and with the method washing a carpet using the disclosed carpet washing equipment.

In the equipment of the invention the same frame includes a conveyor for transferring the carpet between the washing and drying units of the equipment, a control unit for controlling the operation of the equipment, at least one washing unit and at least one drying unit located after the washing unit/units in the transport direction, and means for receiving production goods to the equipment. In the equipment, the conveyor can move the carpet through the washing and drying units of the equipment at the same speed. The washing unit comprises a wet or dry cleaning unit with at least one brush and means for moving the carpet (M). Each drying unit contains a blowing apparatus blowing compressed air onto the carpet, the blowing apparatus being able to blow compressed air with a pressure of 2-15 bars, preferably 2-6 bars onto the pile side of the carpet (M), the blowing pressure being dependent on the carpet type and/or carpet's transfer speed at the drying station of the drying unit; and with the drying equipment it is possible to blow such an amount of compressed air onto the carpet that the carpet exits from the drying station tack free. The equipment is located in a vehicle by providing it possibly with a water aggregate for receiving water from outside and with a machine unit having means for receiving operating energy and means for converting the received operating energy into medium pressure and volume flow for the medium needed by the equipment, into heating energy for the water to be used in the equipment, and into electric energy needed by the units in the equipment. In addition, the underside of the carpet to be washed with the equipment is so air proof that the air flow blown onto the carpet bounces essentially back from the carpet's underside.

The method of the invention for washing a carpet using the equipment of the invention again comprises the following steps:

- the carpet, the underside of which is so air proof that the air flow blown onto the carpet bounces essentially back from the carpet's underside, is fetched from a building and brought into the equipment located in a vehicle;
- the carpet intended to be washed is transferred through a wet or dry cleaning unit and it is simultaneously wet or dry cleaned in the said washing unit, which comprises at least one brush and means for transferring the said carpet,
- the wet or dry cleaned carpet is transferred from the washing unit to the drying unit and further through the said drying unit so that the carpet's transfer speed is essentially the same through the washing unit and drying unit,
- in the drying unit, compressed air is blown onto the pile side of the carpet (M) with a pressure of 2-15 bars, preferably 2-6 bars, the blowing pressure being dependent on the carpet type and/or carpet's transfer speed at the drying station of the drying unit, whereby such an amount of compressed air is blown onto the carpet that the carpet exits from the drying station tack free,
- the washed carpet (M) is returned back to the same building, from it was fetched, without having to transfer the carpet to an intermediate storage between the equipment and the building.

The invention is based on several matters. The first main objective of the invention is to place the carpet washing equipment into a vehicle for moving the equipment from one place to another. The second main idea of the invention is to wash carpets in situ, at the customer's so that the carpets are fetched from the customer and returned back almost immediately without moving them to be washed elsewhere or without intermediate storage. Thus, the customer gets the same carpet back immediately after the washing process, and there is no need for intermediate storing.

For achieving the said objectives, the equipment is first of all placed into a vehicle so that the water circulation of the equipment is closed and the equipment is made self-sufficient in relation to production goods. This means that no production goods are brought into the equipment when the continuous carpet washing process is in operation.

Secondly, the equipment is arranged to be continuously operating so that the carpet can be received from the customer and the same carpet can be returned back almost immediately. This also means that the carpets need not be kept in an intermediate storage for giving the customer a temporary carpet for the time of washing. In order to make the carpet washing functions continuously operating, the carpet is first washed using wet cleaning, and the water remaining in the carpet in the washing is removed by blowing moisture and water out of the carpet. In order to make the drying transaction sufficiently efficient, first, drying means is used in the drying unit of the equipment of the invention for removing water and moisture from the surface of the carpet's pile side by blowing onto it a large amount (e.g. 10 $m^3$/min) of high pressure air (2-15 bars, preferably 2-6 bars). Secondly, only carpets with an air proof underside are washed with the equipment of the invention so that the air flow bounces back from carpet's the air proof underside, intensifying further the drying unit's effect for removing moisture from the carpet.

The equipment is formed self-sufficient in relation to production goods so that the equipment has its own energy generating unit, which is adapted to be fitted to the operating energy source, such as a vehicle's diesel motor. The equipment further has conversion means for converting the operating energy taken from outside into production goods needed by the carpet washing equipment, i.e. into pressure and volume flow for the medium, such as air, electric energy, and heating energy. No other production goods besides operating energy need advantageously not be brought to the equipment from outside, the operating energy achieving by means of a hydraulic pump a certain volume flow and pressure to the hydraulic liquid circulating in the equipment.

Production goods refer here to any energy form needed by the units of the equipment or volume flow and pressure of a medium, such as air or liquid.

A tack free carpet refers in this application to that the carpet can be moved along a hard base, such as a plastic or wooden floor without it leaving visible moisture onto the base. The moisture content of a tack free carpet is at most 10-20 p %.

An intermediate storage refers in this application to storage, which is located outside the vehicle in which the carpet washing equipment of the present invention is located. Intermediate storing again refers to storing in an intermediate storage.

In an advantageous embodiment of the invention the equipment is placed onto a base in a vehicle, and it is provided with a hydraulic pump. The hydraulic pump is used for taking energy from the vehicle to achieve a volume flow and pressure for hydraulic liquid. The flow and pressure of the hydraulic liquid is used for generating compressed air, heating energy and electric energy by means of suitable devices, such as an electric generator, compressor, and compressor cooler driven by hydraulic motors. The pumping energy needed by the hydraulic pump is advantageously obtained by the vehicle's own motor, such as diesel motor. This achieves the advantage that the equipment and base are formed as an independent entity, inside which it is possible to convert the energy brought onto the base into other energy forms, such as pressure and volume flow in the hydraulic liquid or compressed air, heating energy and electric energy. The base is, for example, a container or body of a vehicle.

Further, in an advantageous embodiment of the invention the equipment has closed water circulation, which contains a water tank for water, pipework for leading water from the fresh water tank into a rinsing unit/units, pipework for leading water from the water tank into a washing unit/units, pipework for leading the water used in the rinsing unit/units and washing unit/units into a grey water tank, and means for heating the water used in the rinsing unit/units and washing unit/units. The water circulation is formed to be closed so that both the volume of the fresh water tank and the volume of the grey water tank is such that a certain number of carpets can be washed with the equipment without bringing fresh water into the equipment and/or removing sewage from the equipment.

When an apparatus, the operation of which is based more on the quick blowing of moisture or water from the carpet's pile than on the slow evaporation of water by means of outside heating energy, is used as the drying unit, this has the advantage that when carpets with an essentially air proof underside are taken through the equipment, it is possible to perform the washing, rinsing and drying steps at the same speed, which is a basic precondition for a continuous carpet washing and drying process. Because the equipment is placed onto a base located in a vehicle, into which it is not necessary to bring other production goods from outside besides (the pump's) operating energy and possibly water, the equipment can be easily moved from one place to another, for example, in a vehicle's container or truck's body.

The drying unit consists advantageously of an apparatus, which advantageously uses the so-called coanda principle so that the amount of compressed air blown with the blower itself is approximately 1/30-1/40 of the total amount of air arriving at the carpet. The high pressure, relatively narrow air jet achieved by the apparatus absorbs a 30 to 40-fold amount of secondary additional air from the environment in relation to the amount of primary compressed air blown from the equipment before the whole air mass comes onto the carpet surface. Thus the equipment generates a considerably large amount of blown air with a small power consumption of the equipment. The operation of the drying unit can be intensified further by directing heating radiation to the carpet at the same time as moisture is removed from it by blowing.

An essentially air proof carpet underside refers to a carpet, which generally lets very little air through the underside. However, the underside may have places that are less tight than the rest of the underside, such as more worn places, which let through more air.

An advantage of the fast air drying unit used in the apparatus is thus that although the pile side of the carpet is brushed in the washing unit below the water surface (wet cleaning), the carpet can be made so dry (tack free) with the said drying unit that it is possible to transfer the carpet through the washing, rinsing and drying units at the same speed. In this case the washing, rinsing and drying of the carpet can be performed continuously for several successive carpets.

In an advantageous embodiment of the invention the drying unit consists of two or several longitudinal air blowers, which are situated sequentially in the longitudinal direction, transverse to the transport direction of the carpet. The advantage of such a drying unit is that the width of the air jet coming from the blower can be adjusted to be equivalent to the width of the carpet travelling through the equipment.

In another advantageous embodiment of the invention the equipment comprises several drying units and/or rinsing units and/or washing units located sequentially in the transport direction of the carpet. In addition, counter-clockwise to the transport direction of the carpet there may be located one or several brushes or suction devices before the washing unit/washing units for dry brushing or vacuuming the carpet before it arrives at the washing unit/washing units.

In another advantageous embodiment of the invention the carpet rinsing station with a rinsing unit is located in relation to the wash basin so that rinsing water travels by gravity from the rinsing station to the wash basin. Thus the advantage is achieved that rinsing water can also be used as carpet washing water, which reduces the amount of fresh replacement water needed in the water circulation.

Still in another advantageous embodiment of the invention the carpet rolling unit is located after the drying unit.

BRIEF DESCRIPTION OF THE DRAWING FIGURES

Other advantages and embodiments of the invention are disclosed in the following figures, which illustrate the invention in more detail.

DETAILED DESCRIPTION OF THE INVENTION

Figure 1:
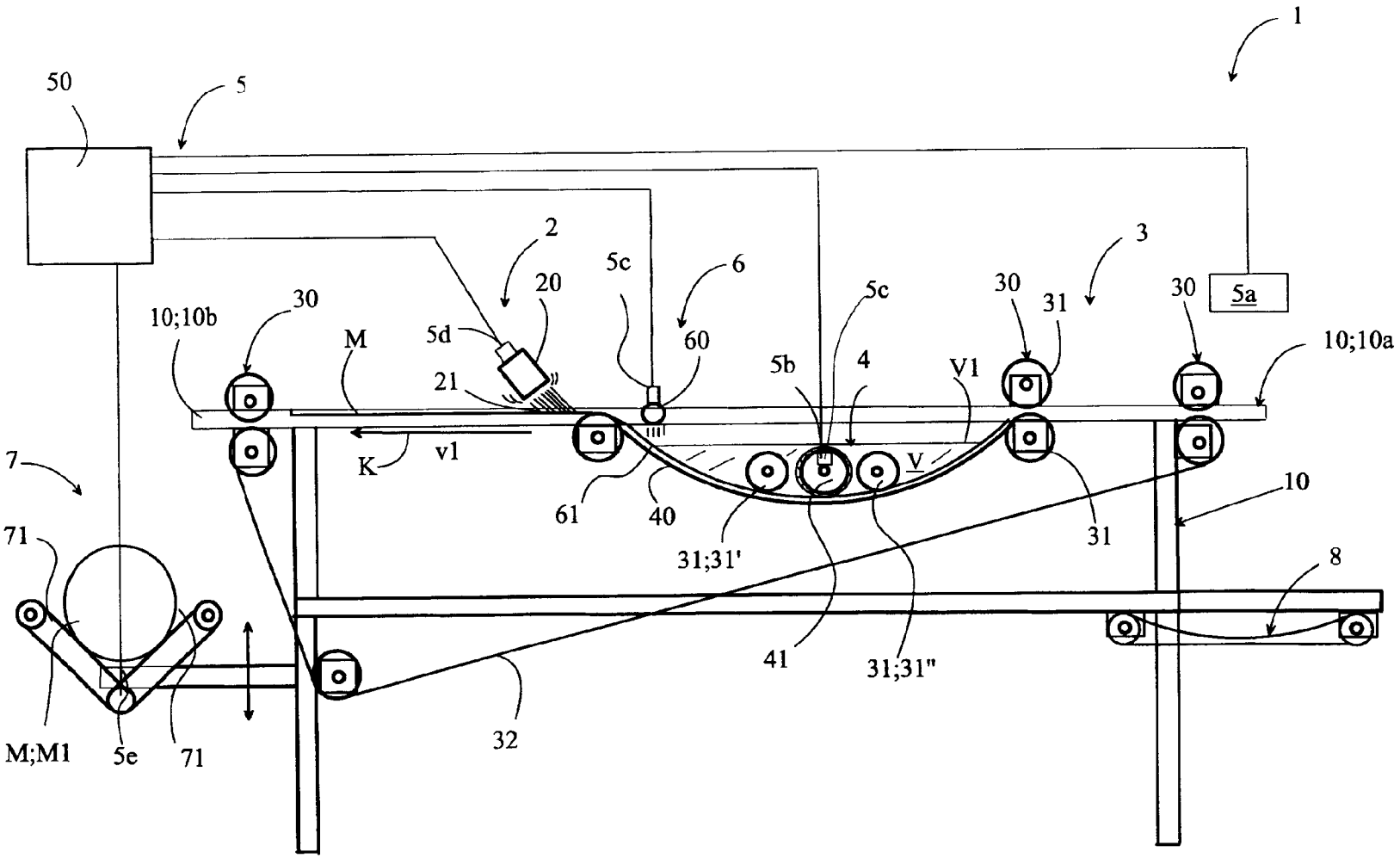
FIG. 1 is a cross-sectional side view of the equipment of the invention.
Figure 2:
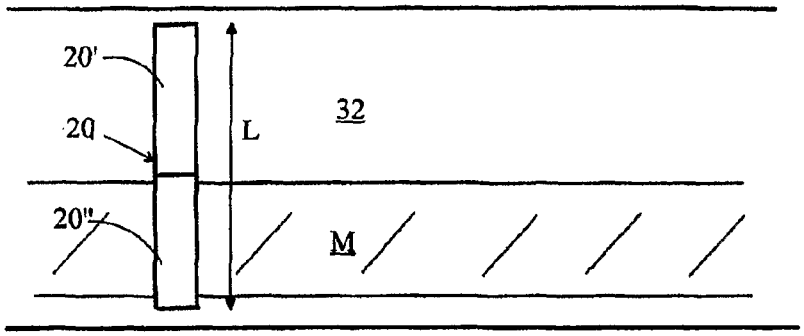
FIG. 2 is a top view of the area of the drying unit in FIG. 1.

The main parts of the equipment 1 illustrated in FIGS. 1 and 2 are the equipment frame 10, which contains sequentially, in the travel direction K of the carpet: the feed unit 8, the wash basin of the washing unit 4 fitted into the frame 10, the rinsing unit 6, the drying unit 2, and the rolling unit 7. In addition, the equipment includes the conveyor 3 for transporting the carpet M between the units stated above. The functions of the unit of the equipment 1 are controlled and adjusted with the control unit 5. The equipment is as a whole placed onto a base, which is part of a vehicle, such as a truck pallet or a trailer lorry container.

Figure 3:
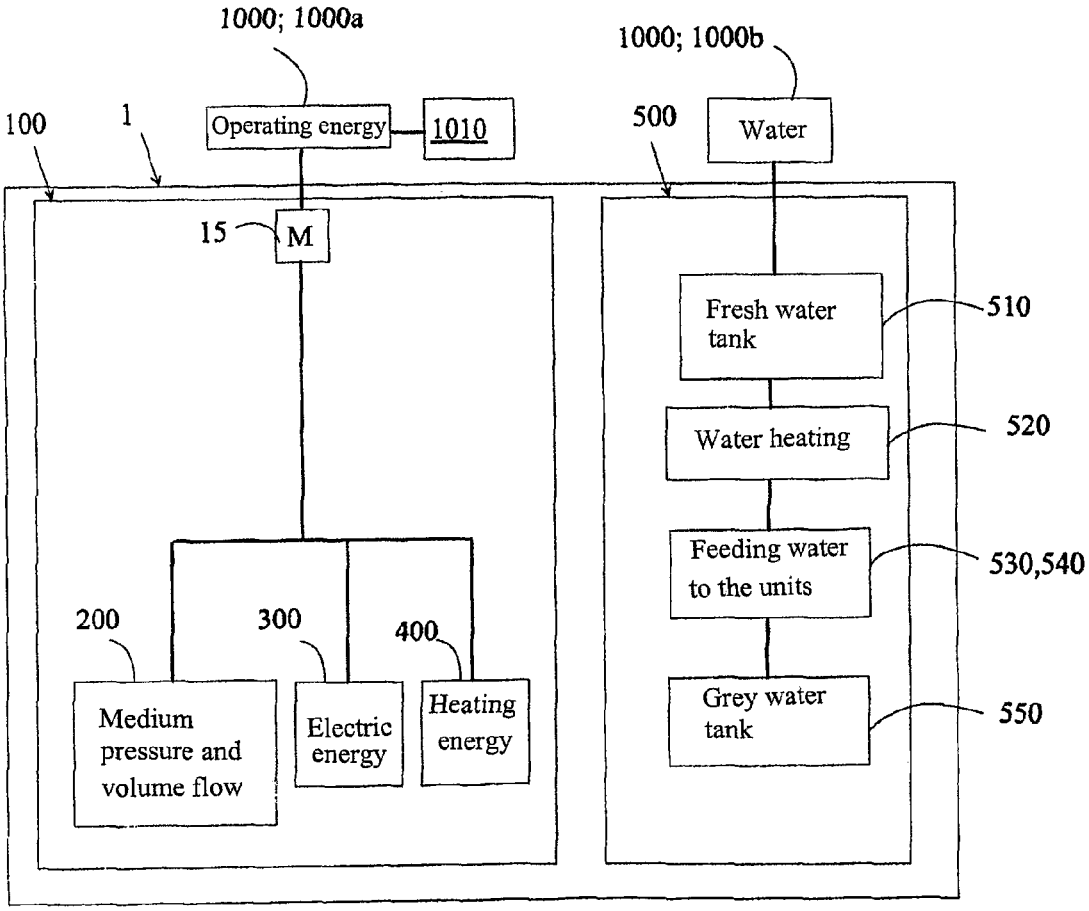
FIG. 3 is a block diagram of the production of production goods needed by the equipment.

In FIG. 3 it can be seen how the equipment 1 has been arranged as an independent production unit, to which production goods need not be brought from outside. Operating energy 1000; 1000*a* is brought into the equipment by means of the vehicle's (not shown in the figures) diesel motor 1010, and from time to time water 1000; 1000*b*. The operating energy 1000*a* brought from outside is converted into thermal energy 400 and electric energy 300 and medium (air) pressure and volume flow 200 by means of a hydraulic machine unit 100. The machine unit 100 has a hydraulic pump 15, with which compressed air 200 used in the drying unit 2, thermal energy 400 used for heating the water in the water circulation, and electric energy 300 needed by different units are generated by means of suitable devices connected to the hydraulic liquid circulation.

Figure 4:
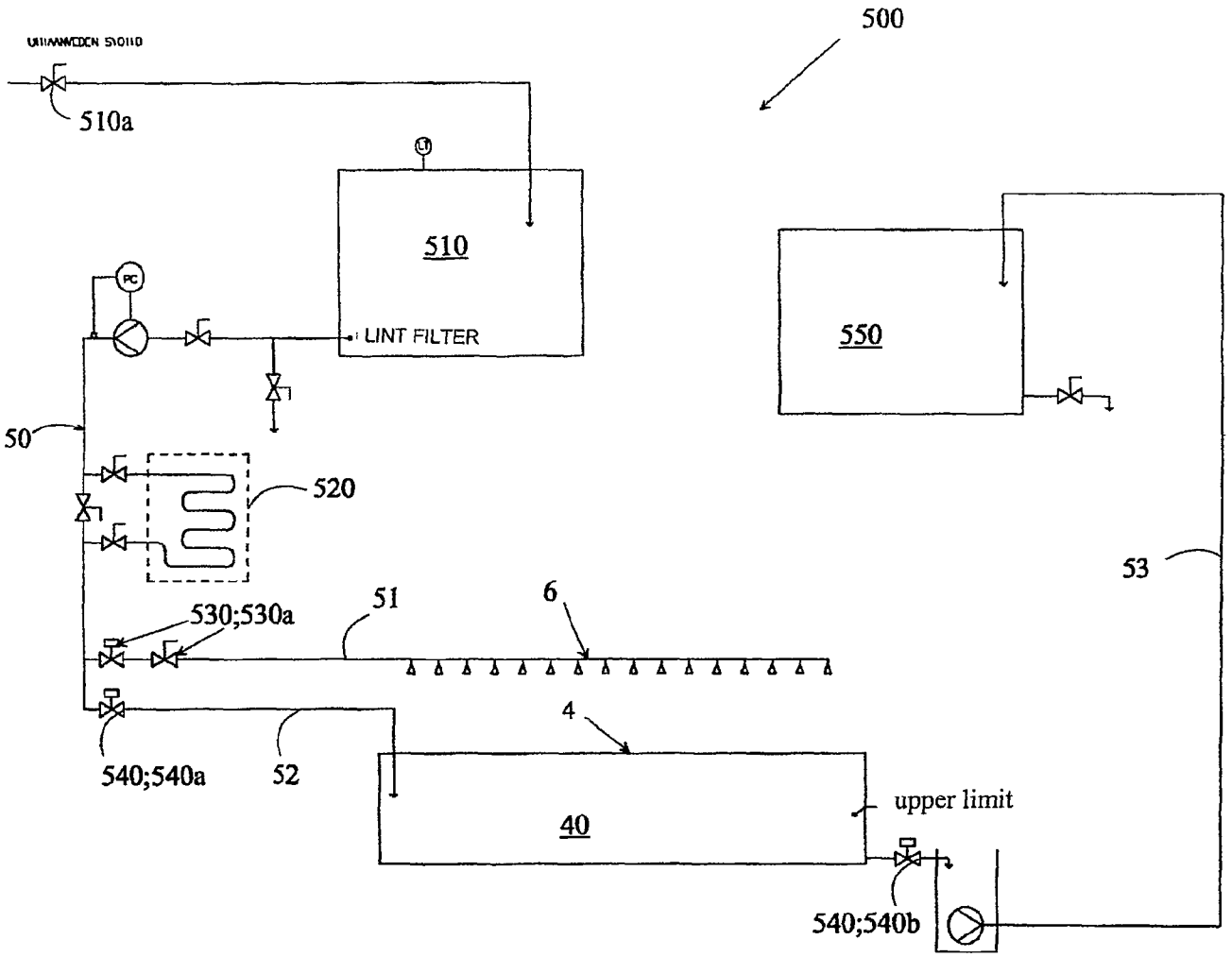
FIG. 4 illustrates diagrammatically the water circulation of the equipment.

The main parts of the water circulation 500 seen in FIG. 4 are again the water pipework 50, tank 510 for replacement water (fresh water), heat exchanger 520, means 530 for feeding water to the rinsing unit 6, water feed and discharge means 540 for the wash basin 40 in the washing unit 4, and grey water tank 550.

Figure 5:
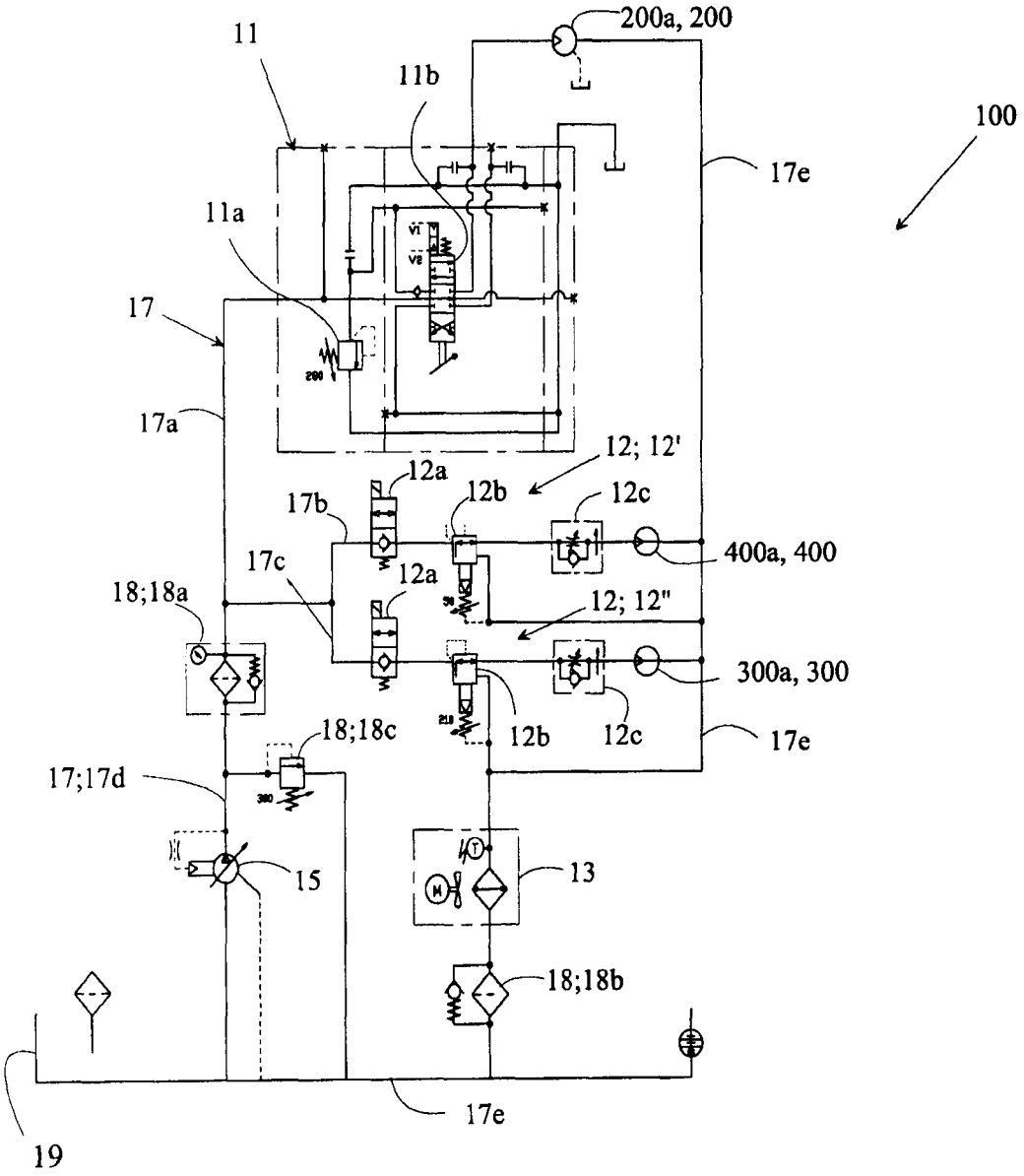
FIG. 5 illustrates an embodiment for producing the production goods needed by the units of the equipment using a hydraulic machine unit.

The conversion of the operating energy 1000*a* brought to the hydraulic pump 15 of the equipment from the diesel motor into medium (air) pressure and volume flow 200, electric energy 300 and thermal energy 400 can be seen in FIG. 5. From the exemplary hydraulic diagram in FIG. 5 it is seen how the pressure and volume flow of the hydraulic liquid generated by the hydraulic pump 15 with variable volume is converted into pressure and volume flow 200 tied to air using a compressor, into thermal energy 400 by the compressor cooler through the heat exchanger, and into electric energy 300 by an electric generator. The compressor, compressor cooler and electric generator are driven by corresponding hydraulic motors 200*a*, 400*a* and 300*a*. Thermal energy 400 of the compressor cooler (=compressor's lost heat) is recovered by the heat exchanger 520 shown in FIG. 4.

In the equipment 1 of the invention the conveyor 3 is used for transporting and supporting the carpet M during transport. The conveyor 3 consists of an endless belt 32 and support rolls 31 moving and supporting the belt. The belt 32 is made of a suitable material, such as mesh-structured plastics, the width of the belt 32 being approximately the same as the width of the frame 10 and the wash basin in the transverse direction of the equipment. The endless belt 32 is moved in the roll nip between the support rolls 31 in the support roll pairs 30 in the direction of the arrow K. At the first end 10; 10*a* of the frame, in front of which there is located the feed unit 8, the carpet M is fed onto the belt 32 of the conveyor 3. From the first end 10; 10*a* the belt is moved to the vicinity of the bottom of the wash basin 40 and further to the rinsing station 61 at the upper edge of the wash basin and to the drying station 21. From the drying station the endless belt 32 is transported to the second end 10; 10*b* of the frame, where the rolling unit 7 is located. From the second end 10*b* of the frame 10 the endless belt 32 is then circulated back to the first end 10*a* of the frame 10.

The washing unit 4 consists of the wash basin 40 embedded in the frame 10 and of the brush 41 placed in the vicinity of the wash basin bottom and rotating round its longitudinal axis of rotation, and of the longitudinal cylindrical support rolls 31; 31', 31" located on both sides of the brush and belonging to the conveyor 3. Both the brush 41 and the support rolls 31 extend in the transverse direction from the first longitudinal side of the basin 40 to the second longitudinal side. The longitudinal sides of the basin 40 refer to the sides of the basin, which are parallel with the transport direction K of the carpet. The transverse direction of the basin 40 again refers to the transport direction K indicated by an arrow and, at the same time, to the transverse direction of the equipment frame 10 in relation to the vertical axis. In FIG. 1 there is drawn the water surface level V1 in the wash basin 40 when carpets M is being washed with the equipment 1. As can be seen from FIG. 1, both the brush 41 and the support rolls 31; 31' and 31; 31" are located below the water surface of the basin 40 in the washing process, in which the pile side of the carpet M are brushed with the brush 41 rotating in the basin. The washing process can be intensified by feeding detergent into the washing water V and onto the carpet M to be brushed, for example, through the axis of the brush 41 and further through the brush part. Detergent can also be fed onto the carpet either before setting the carpet onto the belt 32 of the conveyor 3 or before transferring the carpet to the washing unit 4 on support rolls.

In the transport direction K of the carpet M indicated by an arrow, the rinsing unit 6 is located next after the washing unit 4. The rinsing unit 6 has a longitudinal injector 60 which is located transverse in relation to the longitudinal direction of the frame 10 and/or the conveyor belt 32 and extending from the first longitudinal side to the second longitudinal side, it being able to achieve a transverse water curtain in relation to the transport direction K. Such a device is, for example, a jet bar with holes in the lower part or a device, which consists of successive jet nozzles. Longitudinal sides of the frame 10 or the conveyor belt 32 refer to sides, which are parallel with the transport direction K of the carpet M. Rinsing water is fed by the injector 60 to the rinsing station 61 located perpendicularly below the device 60, the carpet M being moved through the rinsing station at a certain speed. The rinsing station 61 is located in the upper part of the wash basin 40 higher than the washing unit 4, because of which water travels from the rinsing station 61 to the washing unit 4 by means of gravity.

The drying unit 2 is located after the rinsing unit 6 in the transport direction K of the carpet M. The drying unit 2 has a two-part air blowing device 20 (cf. FIG. 2) consisting of two successively arranged so-called air knives 20; 20' and 20; 20", the joint length of which in the lateral direction of the equipment frame 10 is the same as the biggest possible width of the carpet M transported on the endless belt 32. Each air blowing device 20 is a longitudinal so-called air knife placed transversely in relation to the carpet's transport direction K and blowing high-pressure air, which makes use of the venturi and coanda phenomena. High pressure air is blown through the head of the air knife 20 exactly as a parallel thin laminar jet to the drying station 21 below the air knife 20. The high pressure air travelling through the air knife head takes along from the environment approximately 30 to 40-fold amount of air in relation to the amount of air blown through the head of the air knife 20. The amount of air taken along by the air flow travelling through the head of the air knife 20 depends directly on the distance of the air knife head and the carpet M in the drying station 21. Thus, for example, if the distance of the air knife head and the carpet in the drying station 21 is 15 cm, the jet is 51 mm thick when arriving onto the carpet. If again the distance of the air knife head and the carpet in the drying station 21 is 30 cm, the jet is 102 mm thick when arriving onto the carpet. When the carpet M provided with an air proof underside is transported pile side up through the drying station 21, the water removing effect of the air knife 20 is intensified further, because the air flow blown onto the carpet pile bounces back from the air proof underside of the carpet, simultaneously removing more water from the pile. A suitable blowing capacity for compressed air by the blower 20 is 2-6 bars, and the amount of air blown from the end of the blower 20 is 5-15 $m^3$ air per minute. The pressure and amount of blown air is dimensioned on the basis of the type of the carpet M and the carpet's transfer speed through the drying station 21. However, generally the blowing capacity of 2-12 bars is used, and most preferably the blowing capacity of 2-6 bars. With the drying unit 2 it is the intention to dry the carpet approximately tack-free, i.e. to the moisture of approximately 1-20 p-%, preferably to 10-15 p-%, when the carpet can be transported through the carpet drying station 21 as fast as it is transported through the rinsing and washing units.

After the drying unit 2 in the transport direction K of the carpet, the rolling unit 7 is seen in FIG. 1. The carpet M dried in it is rolled into the roll M1, and after that the dried and rolled carpet M; M1 is brought down on the support arms 71 of the rolling unit 7.

The equipment 1 of the invention comprises further the control unit 5, which has been shown diagrammatically in FIG. 1. The control unit 5 comprises the data processing apparatus 50, such as a computer, a number of sensors (not shown in the Figure) monitoring the status of the units 8, 2, 4, 5, 7 and the conveyor 3, a number of adjusting devices 5*a*, 5*b*, 5*c*, 5*d* and 5*e* placed by the units and the conveyor, and programmable logic, which controls the adjusting devices 5*a*, 5*b*, 5*c*, 5*d* and 5*e* on the basis of data received from the sensors. Light cells can be mentioned as an example of sensors, the light cells controlling the operation of the conveyor 3 by means of the adjusting device 5*a* (e.g. stopping the conveyor belt 32 as the carpet exits the equipment and rotating the conveyor belt 32 as the carpet arrives at the conveyor), and the thermometer for the water in the wash basin 40. By means of the control unit 5 it is, for example, possible to control the functions of the following units by means of a suitable unit-specific adjusting device: washing speed and washing efficiency in the wash basin by adjusting the rotational speed of the brush 51, the travel of the carpet by controlling the conveyor 3 on and off, the water temperature in the basin 40 by feeding warm water to the basin or by heating water, for example, by means of the heat exchanger 520, to the primary side of which loss heat from the compressor used for generating compressed air needed in the drying unit 2 is fed (cf. explanation of FIGS. 4 and 5). Further, by means of the control unit 5 it is possible to adjust the moisture of the carpet M after the drying unit 2 by adjusting the speed of the belt 32 of the conveyor 3 and/or the blower's blowing capacity and the amount of blown air, the water surface V1 in the basin 40 by opening and closing the valve of grey water going to the water circulation from the basin 40 and the valve of clean water arriving at the basin. Further, the control unit 5 can be used for opening and closing the compressed air feed to the air blower 20 of the drying unit 2. Also monitoring data can be obtained from the control unit 5, which can be used when planning the carpet washing process. These are, among others, monitoring the condition of the carpet, registration of details of the carpet washing process, and maintenance of the customer file.

In FIGS. 3 and 5 it can be seen how the (hydraulic) machine unit 100 is used for generating the pressure and volume flow 200 for compressed air blown onto the carpet by the air blower 20 of the drying unit 2, the control unit's electric energy 300 needed by the washing unit 4, and the water heating energy 400 delivered to the wash basin 40 and the jet device 60 of the rinsing unit 6.

The exemplary hydraulic machine unit 100 illustrated in FIG. 5 consists of the hydraulic pump 15 with variable volume, to which the hydraulic motor 200*a* for the compressor, the hydraulic motor 400*a* for the compressor cooler, and the hydraulic motor 300*a* for the generator have been connected via the pipework 17. In the flow direction of the hydraulic liquid leaving from the hydraulic pump 15, the pipework 17 consists of the feed pipework 17*d*, which is divided into three pipework sections 17*a*, 17*b*, 17*c* after the countervalve 18; 18*a* restricting the direction of flow, the three pipeworks leading correspondingly to the compressor's hydraulic motor 200*a*, the hydraulic motor 400*a* for the compressor cooler, and the hydraulic motor 400*a* for the electric generator. The pressure and volume flow of the liquid flow arriving at the compressor's hydraulic motor 200*a* from the pipework section 17*a* after the hydraulic pump 15 is adjusted by the flow control circuit 11, comprising the pressure relief valve 11*a* and the magnetically controlled on/off control valve 11*b*. The volume flow of the liquid the compressor requires via the hydraulic motor 200*a* is relatively big so that also the volume flow that passes through the control valve 11; 11*b* has to be dimensioned big.

The respective pipework sections 17*b* and 17*c* lead to the hydraulic motor 400*a* for the compressor cooler and to the generator's hydraulic motor 300*a*. The pipework sections 17*c* and 17*b* have the corresponding control circuits 12; 12' and 12; 12", which are used for adjusting the volume flow and pressure of the hydraulic liquid arriving at the compressor cooler's hydraulic motor 400*a* and the generator's hydraulic motor 300*a* from the pipework sections 17*b* and 17*c*. The control circuits 12; 12' and 12; 12" have similar flow control elements, which consist of the valve 12*a* switching the flow on and off, the pressure relief valve 12*b*, and the volume flow relief valve 12*c*. The flows discharging from the compressor's hydraulic motor 200*a*, compressor cooler's hydraulic motor 400*a*, and electric generator's hydraulic motor 300*a* join the same pipework section 17*e*, which leads back to the tank 19 on the suction side of the hydraulic pump 15. Before arriving at the tank 19, the liquid flowing in the pipework section 17*e* is cooled with the cooler 13. In addition, the pipework section 17*e* has the pressure relief valve 18; 18*c* and the countervalve 18; 18*b* restricting the direction of flow.

The water circulation 500 used in the equipment 1 of the invention has the water pipework 50, the fresh water tank 510 with the water aggregate 510*a* for receiving water from outside the equipment, the heat exchanger 520, the water feed means 530 to the rinsing unit 6, the water feed and discharge means 540; 540*a*, 540*b* to the wash basin 40, and the grey water tank 550.

From the fresh water tank 510, water is lead according to need through the pipework 50 to the jet apparatus of the carpet rinsing unit 6 and to the wash basin 40 of the washing unit 4. Both the pipework section 51 leading to the rinsing unit 6 and the pipework section 52 leading to the washing unit's water basin 40 have cut-off valves 530; 530*a* and 540; 540*a*. Before arriving at the rinsing unit 6 and the water basin 40, water arriving from the tank 550 is heated by the heat exchanger 520, the liquid flowing on the primary side of which is heated by the compressor's loss heat 200. The water basin 40 has a sensor detecting the upper limit for the water surface. The control unit 5 opens and closes the water discharge valve 540; 540*b*, if the water surface level V1 in the water basin exceeds the predetermined upper limit. Water can be removed from the basin 40 also as overflow when the water surface exceeds a certain level. Water removed from the basin travels to the grey water tank 550 along the pipework section 53. The volume of the tank 550 is such that it can receive a sufficient amount of water used for the washing and rinsing of a certain number of carpets without it being necessary to empty the said tank inbetween. The tank 550 will be emptied from time to time, for example, at the end of the working day. Also the fresh water tank 510 is preferably dimensioned so that its volume is sufficient to retain the amount of water, which is enough to wash and rinse a certain number of carpets so that washing and rinsing water need not be added to the tank inbetween. In the closed water circulation 500 described above and because of the fresh water tank 510 and grey water tank 550 located in it, the equipment 1 need not be located near sewerage or water intake point. This renders a possibility to perform the carpet washing independent of water intake or discharge.

The operation of the equipment of the invention is as follows:

The carpet M is placed pile side up onto the conveyor's endless belt 32 at the first end 10*a* of the frame. The carpet's M underside facing the endless belt 32 is made of air proof material. The carpet M is transferred from the conveyor's 3 belt 32 first through the wash basin 40 of the carpet washing unit 4 at a certain speed v1. In this case, the carpet M is moved by the conveyor belt 32 to below the water surface V1, under the rotating brush 41 so that its pile side is brushed. When brushing the carpet, the water surface V1 in the basin 40 is kept above both the brush 41 and the transport rolls 31; 31' and 31; 31" on both sides of the brush so that the washing of the carpet M is performed as wet cleaning.

The carpet M is moved by the endless belt 32 of the conveyor 3 from the washing unit 4 to the rinsing unit 6 located at the edge of the basin 40 at the same speed v1 as when transferring it through the wash basin 40 in the washing unit 4. The carpet is moved through the rinsing station 61 below the spray apparatus 60 generating a water curtain in the rinsing unit 6 at the speed v1 and, at the same time, water is sprayed onto the carpet by the injector 60. From the rinsing unit 6 the carpet M is further transported to the drying unit 2 at the speed v1. The air knife 20 in the rinsing unit 2 blows compressed air onto the pile side of the carpet in the drying station 21 below the blower. The pressure of the compressed air blown was approximately 5-15 bars, and the volume flow 5-15 $m^3$/min. When arriving onto the carpet, the volume flow increased to be 30-fold in relation to the volume flow passing through the air knife head, i.e. to approximately 150-450 $m^3$/min, preferably to 300 $m^3$/min; as the carpet's transport speed was 0.5 m/min so that the effect removing moisture from the carpet pile was considerably big. The amount and pressure of the compressed air blown depend on the water adhered to the pile of the carpet in the washing and rinsing steps, the type of the carpet, and the carpet's transport speed v1 in the drying station 21. The farther away the blower is from the carpet's surface, the more additional air is taken from the environment by the compressed air flow coming from the blower so that the width of the air jet grows. The thickness and volume flow of the air jet is thus transversely comparable to the distance between the carpet in the drying station 21 and the blower head of the air blower 20; if more air is desired to be fed onto the carpet moving through the drying station, the blower is taken farther away from the carpet's surface; and when again less air is desired to be fed onto the carpet moving through the drying station, the blower is brought closer to the carpet surface. In both cases the amount of air leaving the air knife head increased 30-fold per each distance unit.

Thus the carpet M is transported by the conveyor 3 through the equipment units 4, 6, 2 at the same speed v1, i.e. the carpet passes through washing, rinsing and drying at the same constant speed v1. After drying, the carpet is transferred to the rolling unit 7, where it is rolled to the roll M1. After rolling, the carpet is lowered down and taken to the customer.

The hydraulic pump 15 of the hydraulic machine unit 100 is driven, for example, by the diesel motor 1010. The hydraulic pump 15 generates a liquid flow with a certain pressure and volume flow to the pipework 17. The pressure and volume flow of the hydraulic liquid flowing in the pipework sections 17*a*, 17*b* and 17*c* are controlled by control circuits 11 and 12; 12' and 12; 12". Thus, the liquid flow going to the compressor's hydraulic motor 200*a* in the pipework section 17; 12*a* is adjusted by the control unit 11, the liquid flow going to the compressor cooler's hydraulic motor 400*a* in the pipework section 17; 17*b* is controlled by the control circuit 12; 12', and the liquid flow going to the generator's hydraulic motor 300*a* is controlled by the control unit 12; 12". In this way the volume flow and pressure 200 of compressed air needed by the air knife 20 of the drying unit 2 is generated by the compressor driven by the hydraulic motor 200*a*. The hydraulic motor 400*a* is used for driving to the compressor cooler, which received the loss heat 400 freed from the compressor. The loss heat 400 received by the cooler is then led to the primary side of the heat exchanger 520 in FIG. 5 for heating the water circulating on the secondary side of the said heat exchanger. A generator (not shown in the Figures) is driven by the generator's hydraulic motor 300*a*, and it generates the electric power 300 needed by the control unit 5, washing unit 4, conveyor 3, drying unit 2, rinsing unit 6, possible rolling unit 7, dry brushing and vacuuming unit, and carpet feeding unit 8.

Above there have been illustrated only some advantageous embodiments of the invention and it is obvious for one skilled in the art that it is possible to carry out the invention in many other ways within the inventive idea disclosed.

Thus, the blower 20 can be used for blowing also steam or superheated steam in addition to compressed air. In addition to the blower 20, the drying unit can also comprise, for example, a hot air blower or heat radiator.

In the embodiment of the invention described above, the equipment 1 comprises only one washing, rinsing and drying unit. However, the equipment can also comprise several washing units or rinsing units or drying units arranged sequentially in the transport direction K.

The carpet can be brought onto the conveyor belt 32 pile side down, in which case it will also be brushed pile side down.

When an apparatus is used as the blower 20, in which the amount of air from the apparatus head multiplies when arriving onto the carpet's surface, it is possible to exclude the rinsing unit 6, because the blower 20 blows the dirty water away from the carpet's pile.

The equipment can also comprise a dry brushing and/or vacuuming unit before the washing unit 4, in which unit solid material and larger pieces of rubbish are brushed and vacuumed from the carpet's pile.

A water purification apparatus, such as a clarification basin can also be connected to the water circulation for reducing the amount of new replacement water to be taken to the water circulation.

The invention claimed is:

1. Equipment for washing a carpet (M), the equipment comprising:

a vehicle with a motor (1010);

a machine unit (100) within the vehicle, the machine unit (100) including an hydraulic pump (15) and an electric motor, the motor of the vehicle being connected to the hydraulic pump (15) to generate electricity, as well as pressure and volume flow for hydraulic liquid;

an equipment frame (10) integrated into the vehicle;

a conveyor (3), a washing unit (4), and a drying unit (2) carried by the frame (10), the conveyor (3) comprising an endless belt (32) extending from a first feeding end (10*a*) of the frame to a second discharge end (10*b*) of the frame, the frame having a planar surface extending from the first feed end (10*a*) to the second discharge end (10*b*), the washing unit (4) comprising a wash basin (40), in use the wash basin holding water having a water surface (V1) that is located below the planar surface between the first feed end (10*a*) to the second discharge end (10*b*), the washing unit further comprising, inside the wash basin, i) a brush (41) that is located below the water surface (V1) and ii) means for transporting the carpet out of the wash basin, the drying unit (2) comprising i) a drying station (21) located downstream of a exit of the wash basin (40), and ii) drying unit (20) located above and directed toward the drying station (21), wherein the drying unit (2) has an air blowing device (20) comprised of an air knife (20) making use of venturi and coanda phenomena to blow compressed air from an exit of the air knife onto the carpet located on the drying station (21), the compressed air being a parallel laminar air jet of compressed air directed towards the drying station (21) and exiting the air knife (20) at a blowing pressure of 2-15 bars onto a pile side of the carpet (M);

wherein the conveyor (3) transfers the carpet (M), in a transport direction (K), directly from the washing unit (4) to the drying station (21) of the drying unit (2) with a ply side of the carpet facing the exit of the air knife;

a control unit (5) that controls operation of the conveyor (3), the washing unit (4), and the drying unit (2) so that the conveyor (3) transfers the carpet (M) through the washing and drying units (4, 2) at the same speed, wherein the control unit (5) controls the blowing pressure depending on i) the carpet type and ii) transfer speed of the carpet at the drying station (21) of the drying unit (2) and blowing such an amount of compressed air onto the carpet through said drying apparatus that the carpet exits the drying station (21) tack free, the underside of the carpet being sufficiently air proof that the air flow blown onto the carpet bounces substantially back from the carpet underside, wherein the drying unit thereby provides a rinsing stage by the air jet blowing water away from the carpet's pile, the air blowing pressure of the air jet being adjusted by adjusting a distance between the exit of the air knife and the carpet in the drying station such that a thickness and a volume flow of the air jet is a function of the distance between the carpet in the drying station (21) and the exit of the air knife (20) and when more air is to be fed onto the carpet moving through the drying station, the exit of the air knife is taken farther away from the carpet's surface, and when less air is to be fed onto the carpet moving through the drying station, the exit of the air knife is brought closer to the carpet surface, wherein the equipment is self-sufficient in relation to production goods such that all operating energy for powering the conveyor (3), the washing unit (4), and the drying unit (2), and heating energy (400) for water used in the washing unit (4) is provided exclusively from the motor (1010) of the vehicle, and wherein said equipment is free of any rinsing stage other than said drying unit (2).

2. Equipment (1) according to claim 1, wherein generating means for air pressure and volume flow (200), generating means for heating energy (400), and generating means for electric energy (300) driven by hydraulic motors are connected to the hydraulic pump (15) via pipework (17).

3. Equipment (1) according to claim 1, wherein a water circulation system (500) comprises a water tank (510) for retaining fresh water received from outside of the equipment (1) via an aggregate, means (50) for leading water from the water tank (510) to the washing unit and washing unit (4), means (50) for leading water used in the washing unit and washing unit (4) into a grey water tank (550), and means (520) for heating the water used in the washing unit and washing unit (4).

4. Equipment (1) according to claim 3, wherein the water circulation (510) is closed and a volume of the grey water tank (550) in the water circulation is sufficient to wash a certain number of carpets with the equipment without taking replacement water into and/or removing waste water from the equipment.

5. Equipment (1) according to claim 2, wherein the generating means for heating energy (400) comprises means for heating the water used in the washing unit and washing unit (4), and they include a heat exchanger (520) which is adapted to receive loss heat (400) freed from an air compressor.

6. Equipment (1) according to claim 5, wherein liquid flow coming from a cooling device of the air compressor and the water flow arriving from a fresh water tank (510) are connected to the heat exchanger (520).

7. Equipment (1) according to claim 2, wherein the generating means for electric energy (300) is an electric generator.

8. Equipment (1) according to claim 2, wherein the generating means for air pressure and volume flow (200) is a compressor.

9. Equipment (1) according to claim 8, wherein the compressor is connected to the air knife (20) of the drying unit (2), the blowing capacity of which is 2-15 bars and the amount of air from the blower is approximately 5-15 $m^3$/min, so that the blowing capacity and the blown amount of air depend on the moisture of the carpet (M), carpet type and/or carpet's transport speed on the conveyor (3), and the width of the drying unit (2) is such that the drying unit extends from one edge to the other edge in the direction of width of the carpet (M) moved on an endless belt of the conveyor.

10. Equipment (1) according to claim 9, wherein the drying unit (2) comprises at least two longitudinal air knives (20), which are located sequentially, transverse to the transport direction (K) of the carpet.

11. Equipment (1) according to claim 10, wherein the air knives (20) functions so that the air flow directed from its head to the drying station (21) takes with it a 30 to 40-fold amount of air from its environment before air arrives at the drying station (21).

12. Equipment (1) according to claim 1, wherein the equipment (1) further includes a dry brushing or vacuuming unit before the washing unit (4).

13. Equipment (1) according to claim 2, further comprising a carpet rolling unit (7), wherein the control unit (5) comprises at least means for controlling and adjusting the water surface (V1) of a wash basin of the washing unit (4) and for controlling the on/off functions of the washing unit's brush (41) and the brushing speed and for adjusting the transfer speed of the endless belt (32) of the conveyor, means for controlling the operation of the rolling unit (7), and means for adjusting the blowing capacity of the blower in the drying unit (2) and the blown amount of air, and for controlling the on/off functions.

14. Equipment (1) according to claim 13, wherein the control unit (5) has means for adjusting the rotating speed of the washing unit's brush (41) and for keeping the temperature of the water (V) in the basin (40) at a certain temperature.

15. Equipment (1) according to claim 1, wherein the equipment has closed water circulation.

16. Method for washing a carpet with the equipment (1) according to claim 1, characterised in that the carpet (M), the underside of which is so air proof that the air flow blown onto the carpet essentially bounces back from the carpet's underside, is fetched from a building and brought into the equipment (1) placed in a vehicle;

the carpet (M) intended to be washed is transferred through the wet cleaning unit and is simultaneously wet cleaned in the washing unit (4), which comprises at least one brush and means for transferring the said carpet (M);

the wet cleaned carpet (M) is transferred directly from the washing unit (4) to the drying unit (2) and further through the said drying unit (2) so that the transfer speed of the carpet between the washing unit (4) and the drying unit (2) is essentially the same;

wherein the drying units provide a rinsing stage by blowing water away from the carpet's pile in that the drying unit (2) compressed air is blown onto the carpet's pile side by a blower with a pressure of 2-15 bars, the blowing pressure depending on the carpet type and/or the carpet's transfer speed at the drying station (21) of the drying unit (2) so much that the carpet exits the drying station (21) tack free;

the washed carpet (M) is returned back to the building, from which the carpet (M) was fetched without transferring the carpet to an intermediate storage between the equipment and the building, wherein said method is free of any rinsing step other than use of said drying units.

17. Equipment for washing a carpet (M), the equipment comprising:

a vehicle with a motor (1010);

an equipment frame (10) integrated into the vehicle and carrying a conveyor (3), a washing unit (4), and a drying unit (2) carried by the frame (10), the conveyor (3) comprising an endless belt (32) extending from a first feeding end (10*a*) of the frame to a second discharge end (10*b*) of the frame, the frame having a planar surface extending from the first feed end (10*a*) to the second discharge end (10*b*), the washing unit (4) comprising a wash basin (40), in use the wash basin holding water having a water surface (V1) that is located below the planar surface between the first feed end (10*a*) to the second discharge end (10*b*), the washing unit further comprising, inside the wash basin, i) a brush (41) that is located below the water surface (V1) and ii) means for transporting the carpet out of the wash basin, the drying unit (2) comprising i) a drying station (21) located downstream of a exit of the wash basin (40), and ii) drying unit (20) located above and directed toward the drying station (21), wherein the conveyor (3) transfers the carpet (M), in a transport direction (K), directly from the washing unit (4) to the drying station (21) of the drying unit (2) with a ply side of the carpet facing the exit of the air knife;

a control unit (5) that controls operation of the conveyor (3), the washing unit (4), and the drying unit (2) so that the conveyor (3) transfers the carpet (M) through the washing and drying units (4, 2) at the same speed, wherein the drying unit (2) has an air blowing device (20) comprised of an air knife (20) making use of venturi and coanda phenomena to blow compressed air from an exit of the air knife onto the carpet located on the drying station (21), the compressed air being a parallel laminer air jet of compressed air directed towards the drying station (21) and exiting the air knife (20) at a blowing pressure of 2-15 bars onto a pile side of the carpet (M), wherein the control unit (5) controls the blowing pressure depending on i) the carpet type and ii) transfer speed of the carpet at the drying station (21) of the drying unit (2) and blowing such an amount of compressed air onto the carpet through said drying apparatus that the carpet exits the drying station (21) tack free, the underside of the carpet being sufficiently air proof that the air flow blown onto the carpet bounces substantially back from the carpet underside, wherein the drying unit thereby provides a rinsing stage by the air jet blowing water away from the carpet's pile, the air blowing pressure of the air jet being adjusted by adjusting a distance between the exit of the air knife and the carpet in the drying station such that a thickness and a volume flow of the air jet is a function of the distance between the carpet in the drying station (21) and the exit of the air knife (20) and when more air is to be fed onto the carpet moving through the drying station, the exit of the air knife is taken farther away from the carpet's surface, and when less air is to be fed onto the carpet moving through the drying station, the exit of the air knife is brought closer to the carpet surface, and wherein said equipment is free of any rinsing stage other than said drying unit (2).

18. the equipment of claim 17, further comprising a machine unit (100) that generates electricity and a volume flow of hydraulic liquid that power the conveyor, the washing unit, and the drying unit, the machine unit (100) operatively connected to the motor of the vehicle such that the equipment is self-sufficient in that that all operating energy for powering the conveyor (3), the washing unit (4), and the drying unit (2), and heating energy (400) for water used in the washing unit (4) is provided exclusively from the motor (1010) of the vehicle, and wherein the air knife (20) provides the air jet over a range of 2-15 bars with the amount of air over a range of 5-15 $m^3$/min, and so that the air jet directed from the exit of the air knife to the drying station (21) takes a 30 to 40-fold amount of air from the environment before the air jet arrives at the drying station (21).

* * * * *